United States Patent [19]

Sugden

[11] 3,965,995

[45] June 29, 1976

[54] MACHINE FOR BORING A LARGE DIAMETER BLIND HOLE

[75] Inventor: David B. Sugden, Kingston Beach, Australia

[73] Assignee: The Robbins Company, Seattle, Wash.

[22] Filed: Mar. 6, 1975

[21] Appl. No.: 555,830

[52] U.S. Cl. ..... 175/57; 175/86; 175/88; 175/91; 175/94; 175/99; 175/102; 175/103; 175/219

[51] Int. Cl.[2] ..... E21D 1/06

[58] Field of Search ..... 175/57, 91, 66, 88, 175/92, 94, 97–99, 102, 103, 106, 86, 202, 203, 207, 219; 299/86, 31

[56] References Cited

UNITED STATES PATENTS

| | | | |
|---|---|---|---|
| 1,046,927 | 12/1912 | Wittich | 175/102 X |
| 1,154,137 | 9/1915 | Sletten et al. | 175/102 X |
| 3,379,264 | 4/1968 | Cox | 175/102 X |
| 3,547,211 | 12/1970 | Christensen et al. | 175/86 |
| 3,695,370 | 10/1972 | Jones | 175/106 |
| 3,710,878 | 1/1973 | Endo et al. | 175/66 |

*Primary Examiner*—Stephen J. Novosad
*Attorney, Agent, or Firm*—Graybeal, Barnard, Uhlier & Hughes

[57] ABSTRACT

A cutter wheel is mounted at the lower end of the machine for rotation about a horizontal tubular support. Cuttings are picked up by buckets on the cutter wheel and are directed into the tubular support to be received by an endless bucket conveyor which carries them upwardly to a discharge station. As the machine is advanced the cutter wheel is rotated to make a first cut in the shape of the leading portion of the cutter wheel. The cutter wheel is then retracted out from the cut and is rotated about the axis of the hole. This repositions the cutter wheel so that when it is advanced again it will make a second cut which crosses the first. This procedure is repeated until the desired cross-sectional configuration (e.g. circular) of the hole is obtained.

18 Claims, 18 Drawing Figures

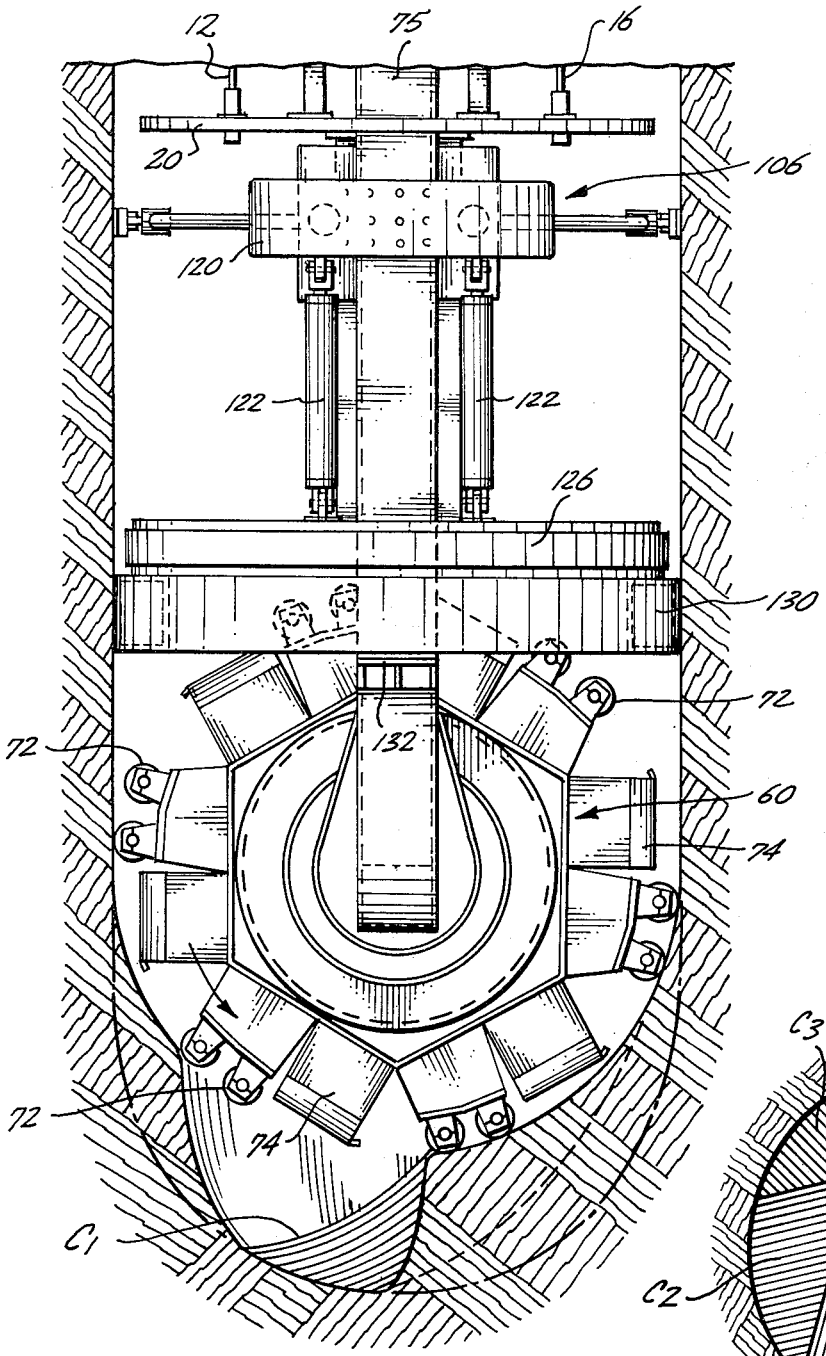
Fig. 7.
Fig. 8.
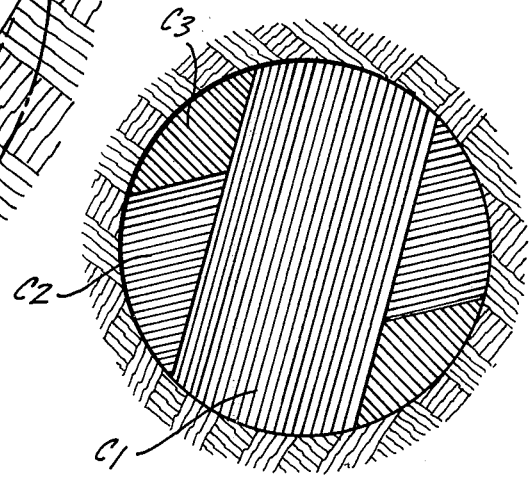

MACHINE FOR BORING A LARGE DIAMETER BLIND HOLE

BACKGROUND OF THE INVENTION

1. Field of the Invention

This invention relates to a field of earth boring and in particular to both method and apparatus aspects of boring a large size blind hole through hard or soft earth formations.

2. Description of the Prior Art

A large number of different types of machines have been proposed for mechanically excavating mine shafts and other relatively large vertical blind holes in earth formations. However, prior attempts to develop such a machine have been generally unsuccessful. For the most part mine shafts and other vertical blind holes are still excavated by drilling and blasting.

Examples of prior art shaft forming machines are shown by the following U.S. Pat. Nos.: 1,132,510, granted Mar. 16, 1915, to Karl Borschutzby; 1,175,952, granted Mar. 21, 1916, to H. G. Hase; 1,406,349; granted Feb. 14, 1922, to Clyde S. Corrigan; 1,988,414, granted Jan. 15, 1935, to P. Bogoutsky; 2,221,226, granted Nov. 12, 1940, to O. M. Wick; 2,769,614, granted Nov. 6, 1956, to Victor Zeni; 2,819,038, granted Jan. 7, 1958, to John E. Eckel; 3,185,226, granted May 25, 1965, to Richard J. Robbins; 3,379,264, granted Apr. 23, 1968, to Kenneth C. Cox; 3,497,021, granted Feb. 24, 1970, to Charles W. Burrell; 3,547,211, granted Dec. 15, 1970, to Alfred W. Christensen and Richard L. Marsing; 3,593,811, granted July 20, 1971, to Jack V. Tedrow; 3,695,370, granted Oct. 3, 1972, to Kenneth W. Jones; and 3,710,878, granted Dec. 4, 1970, to Masaaki Endo, Mituo Miura and Namoru Shinozaki.

SUMMARY OF THE INVENTION

An aspect of the invention is to provide a peripheral entry earth boring machine which is essentially characterized by a cutter wheel which is mounted for rotation about an axis that is transverse to the hole being formed. The cutter wheel includes a peripheral cutter portion and the machine includes motor means for driving the cutter wheel about the horizontal axis. Advance-retract means are provided for advancing the cutter wheel into the earth material being cut while the cutter wheel is being rotated, and for retracting the cutter wheel out from it cut. The machine further includes means for angularly shifting the cutter wheel and its immediate mounting means about the axis of the hole following retraction of the cutter wheel from a cut, to establish a new cut path which is at an angle to the first cut path.

The invention is particularly suited for boring vertical holes, e.g. mine shafts, but has application for any direction hole.

According to an aspect of the invention a cutter wheel having a peripheral cutting portion is mounted for rotation about a horizontal tubular support at the lower end of the machine. One or more drive motors are provided for driving the cutter wheel about the tubular support. During use the machine is advanced vertically downwardly into the earth material being cut while the cutter wheel is being rotated. The cuttings are picked up by the cutter wheel and are directed through the cutter wheel into the tubular support.

According to another aspect of the invention, a conveyor means is provided to pick up cuttings in said tubular support and carry them upwardly to a discharge station. In preferred form the conveyor means is of the endless bucket type. It is mounted to pass axially through the horizontal tubular support, then upwardly on one side of the wheel to the discharge station, and then downwardly on the opposite side of the wheel, to again pass through the horizontal tubular support.

According to a basic method of this invention, a cutter wheel is motor driven about a transverse axis and at the same time such wheel is advanced to move a leading peripheral portion of the wheel into the earth. Once the leading peripheral portion of the cutter wheel has made a cut of substantial depth, the machine is retracted to retract the cutter wheel out from such cut. Then, the cutter wheel is rotated in position about the axis of the hole until it occupies a new cut path which extends across the first cut. Then, the cutter wheel is rotated and advanced as before, to establish a second cut. This procedure is repeated as many times as necessary in crder for the cutter wheel to cut a hole of the deesired cross-sectional configuration. The cutter wheel diameter can be equal to or less than the hole diameter.

Another method aspect of the invention is to bore a blind hole vertically downwardly into the earth by power rotating a cutter wheel having cutter means on its periphery about a horizontal tubular support, while advancing the tubular support, and hence the cutter wheel, vertically downwardly into the ground. Cuttings are picked up by the cutting wheel and are directed through the wheel into the tubular support. The cuttings are then moved by a conveyor out from the tubular support and vertically upwardly to a discharge station. Ultimately, the cuttings are mechanically removed from the hole.

Other more detailed features of the invention, including preferred basic machine forms and methods, forms of machine advancing mechanism, conveyor systems, and wheel repositioning means, are hereinafter described in connection with the illustrated embodiments.

BRIEF DESCRIPTION OF THE DRAWING

FIG. 7 is a view like FIG. 4A, but showing the cutterhead retracted and rotated relative to the first cut of the cutter wheel;

FIG. 8 is a transverse sectional view of the bottom of the hole, showing the multiple cut pattern of the cutter wheel;

DESCRIPTION OF THE PREFERRED EMBODIMENT

Figures 1, 2:
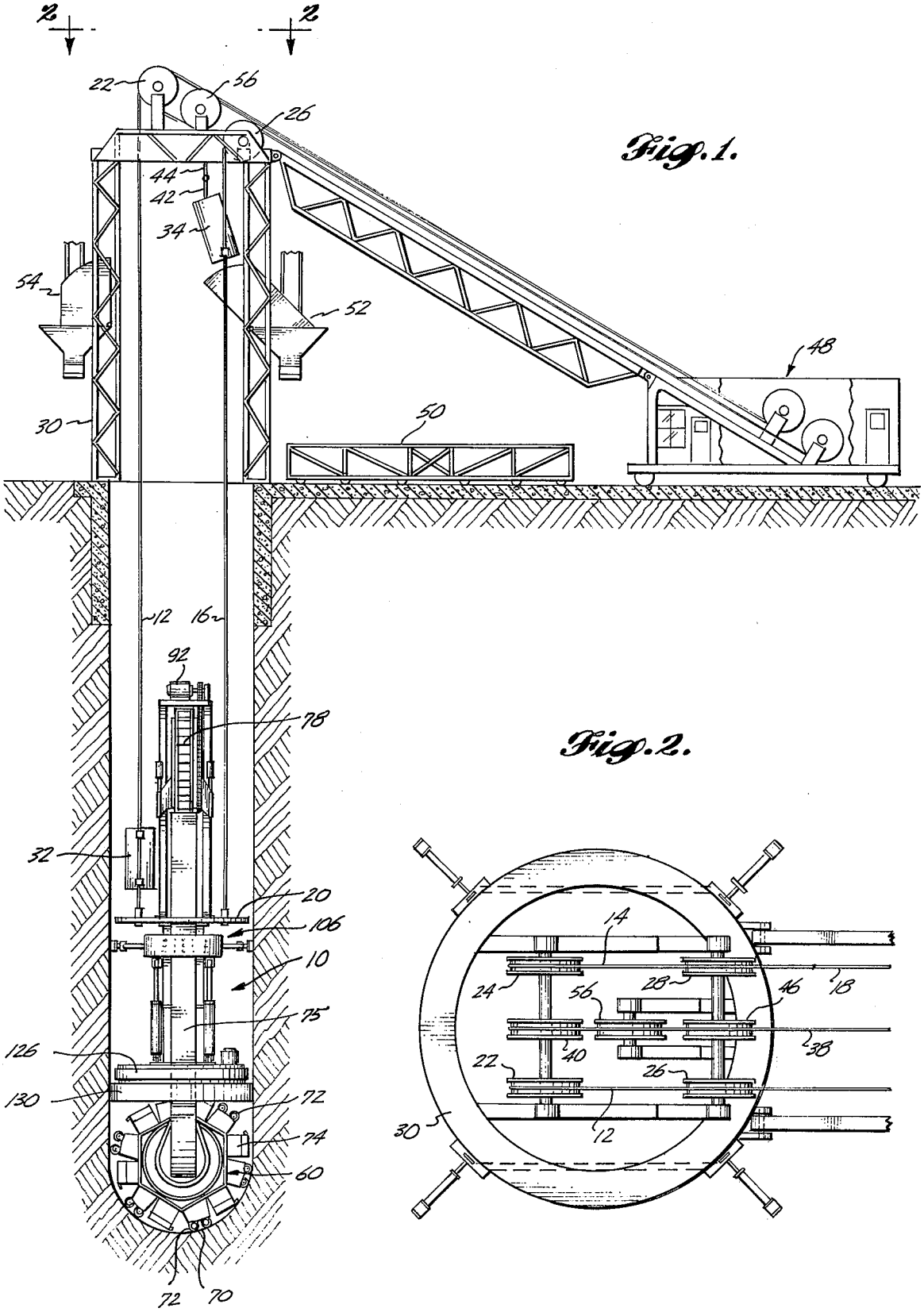
FIG. 1 is an elevational view with some parts in section, showing an embodiment of the invention, including surface support equipment which is used therewith.
FIG. 2 is a top plan view of a portion of the surface support equipment, taken substantially along line 2—2 of FIG. 1.

Referring to FIG. 1, a first machine embodiment of the invention is shown in the process of excavating a vertical hole, such as a mine shaft or the like. It comprises an inhole machine 10 to which a plurality of tensioned cables 12, 14, 16, 18 are connected. Specifically, the cables 12, 14, 16, 18 are connected to corner portions of a platform 20. They extend upwardly from the platform 20 to a set of four pulleys or sheaves 22, 24, 26, 28 which are mounted on top of a tower 30.

Cables 12, 14, serve as guidelines for a first lift bucket 32. Cables 16, 18 serve as guides for a second lift bucket 34. A bridle 36 connects lift bucket 32 with a cable 38 which extends upwardly to and over a sheave 40 which is located between sheaves 22, 24. In similar fashion, a bridle 42 connects bucket 34 with a cable 44 and cable 44 extends upwardly to and over a sheave 46 which is located between sheaves 26, 28. Each of the cables 12, 14, 16, 18, 38, 44 extends from its sheaves 22, 24, 26, 28, 40, 46 down to its own winch drum at a winch station 48, spaced off to one side of the tower 30. The cables 12, 14, 16, 18 are wound onto and paid off from their respective winch drums for the purpose of changing their lengths and maintaining tension. The winch drums for the cables 38, 44 are separately and independently controlled for adjusting the length of line to the loading platform but normally operate as a differential pair.

The surface equipment may also include a sliding erection bridge 50 which in FIG. 1 is shown positioned to the winch station side of the hole. When the machine is first brought to the boring location the erection bridge is slid to the left of its pictured location, to span across the base of tower 30, so that it can serve as a support for trucks carrying the parts of machine 10. When not in use the bridge 50 is slid sideways into the position illustrated. During the first stages of boring the tower 30 is used for guiding the machine.

In a manner to be hereinafter described in detail, as boring progresses the cuttings of earth material are raised upwardly and are discharged into first one and then the other of the lift buckets 32, 34. In FIG. 1. bucket 32 is shown receiving some cuttings and the bucket 34 is shown in an elevated position, with the cuttings from it being discharged into a hopper 52. A similar hopper 54 is provided for bucket 32 on the opposite side of the tower 30. Hoppers 52, 54 serve to accumulate the cuttings and periodically discharge them into a truck or other transporting means provided for carrying them away from the machine site.

As best shown by FIG. 2, a central sheave 56 is provided atop tower 30 to guide a cable (not shown) which is used for erecting the machine 10.

Referring now to FIGS. 3A – 6, the machine 10 is shown to comprise frame means including a horizontal tubular support 58 at the lower end of machine 10. A cutter wheel 60 is mounted for rotation about tubular support 58 by means including a bearing 62. One or more drive motors 64 are carried by the frame means in the vicinity of support tube 58. Each motor 64 drives a small gear 66 which meshes with a large diameter gear 68 carried by wheel 60. Bearing 62 and gear 68 both surround the tubular support 58.

The cutter wheel 60 includes a peripheral cutting portion 70 which carries cutter units 72. These are preferably disc cutters of the general type disclosed by U.S. Pat. No. 3,787,101, granted Jan. 22, 1974. Cutter wheel 60 also includes a plurality of peripheral buckets 74 which upon rotation of cutter wheel 60 scoop up the cuttings and raise them up above the tubular support 58. The cuttings are then deposited by gravity down through an upper sidewall opening 73 into the interior of tubular support 58. This arrangement of handling cuttings is by itself like the arrangement used in axial advance tunneling machines such as, for example, shown by U.S. Pat. No. 3,309,142, granted Mar. 14, 1967 to Douglas F. Winberg.

The frame means for machine 10 includes side beam portions 75, 76 which extend vertically upwardly from the ends of support tube 58, in similar fashion to the front wheel fork tines of a bicycle. In such embodiment frame parts 75, 76 are hollow and together with tubular support 58, they house an endless bucket type of conveyor 78.

Figure 3A:
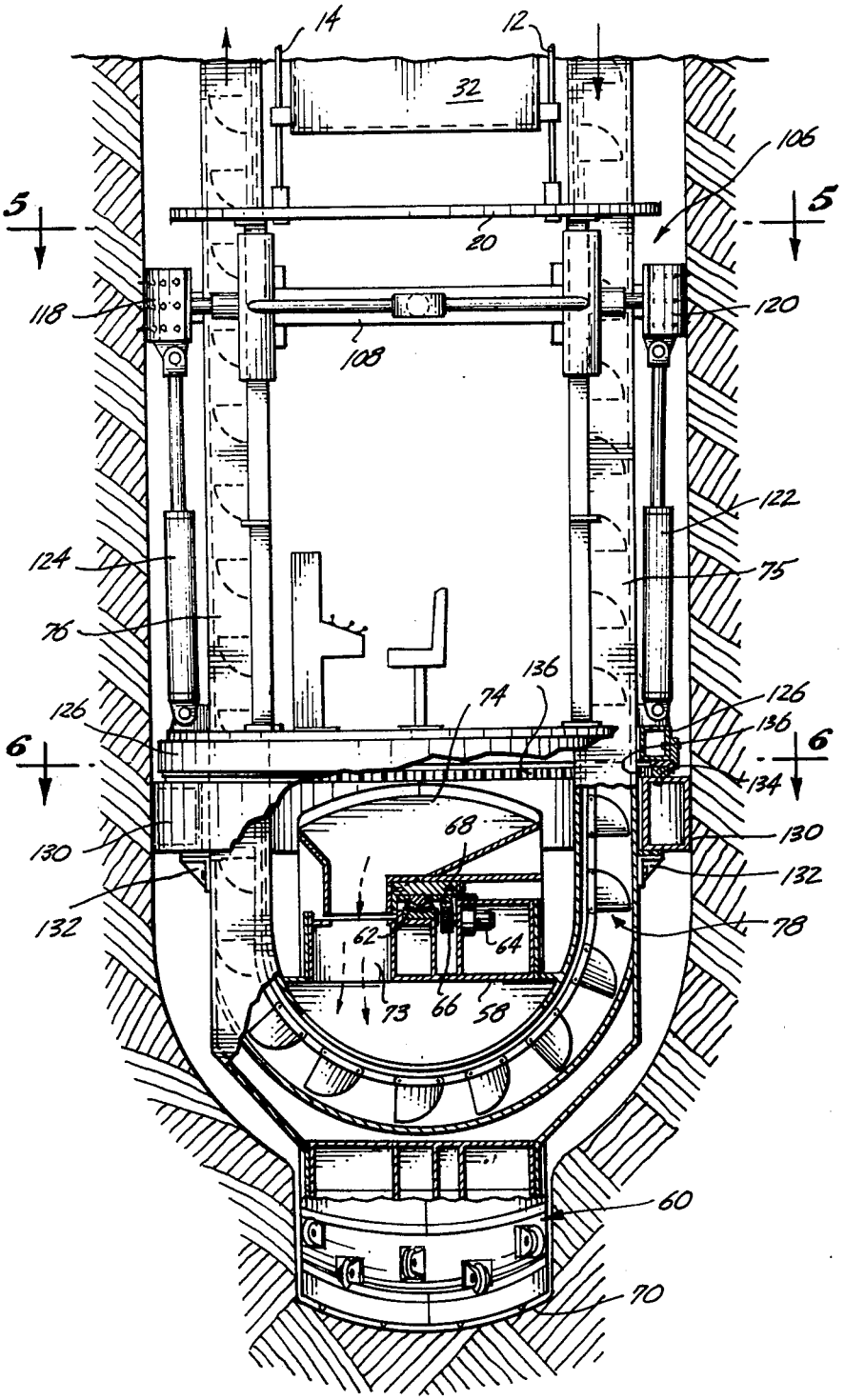
FIG. 3A is an enlarged scale elevational view, with some parts in section, of the lower part of the in-hole machine portion of the equipment shown by FIG. 1, such view being taken at a right angle to the axis of rotation of the cutter wheel, and such view showing the cutter wheel in section, a typical bearing and drive motor arrangement for the cutter wheel and a typical hopper structure for directing the cuttings from the interior of the cutter wheel into the conveyor housing tubular support for the cutter wheel.
Figure 3B:
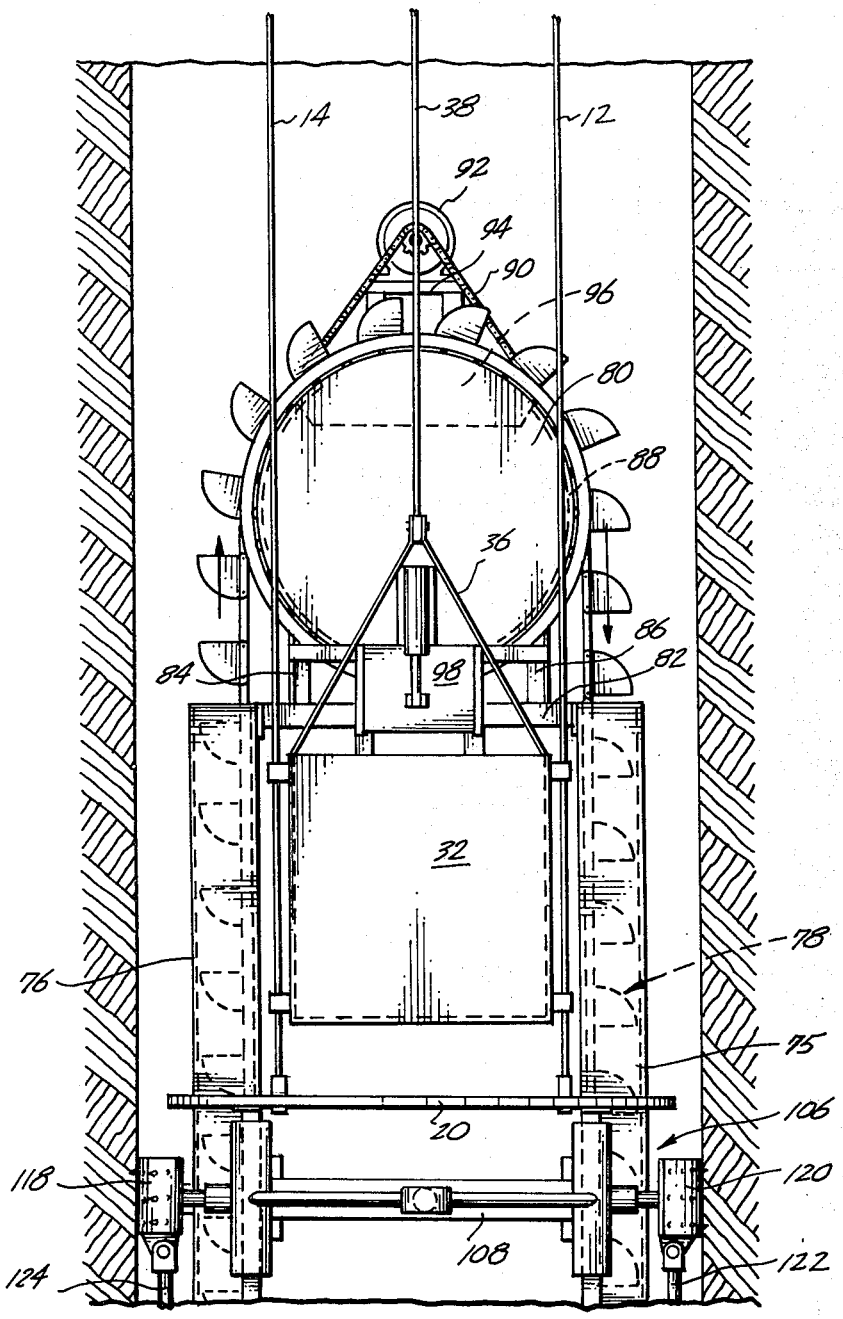
FIG. 3B is a view like FIG. 3A, but of the upper part of the in-hole machine.
Figure 4A:
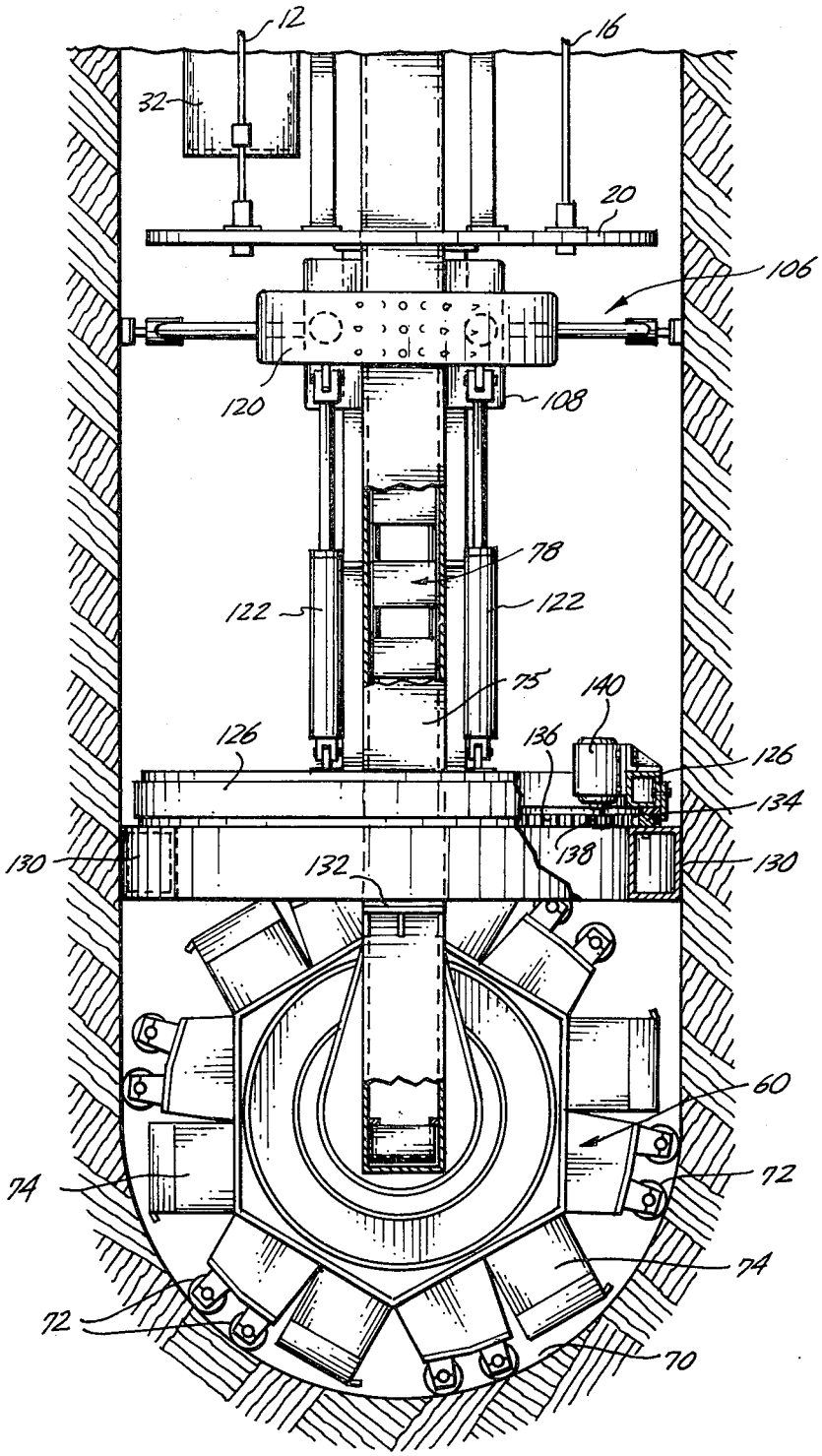
FIG. 4A is a view like FIG. 3A, but looking axially of the cutter wheel.
Figure 4B:
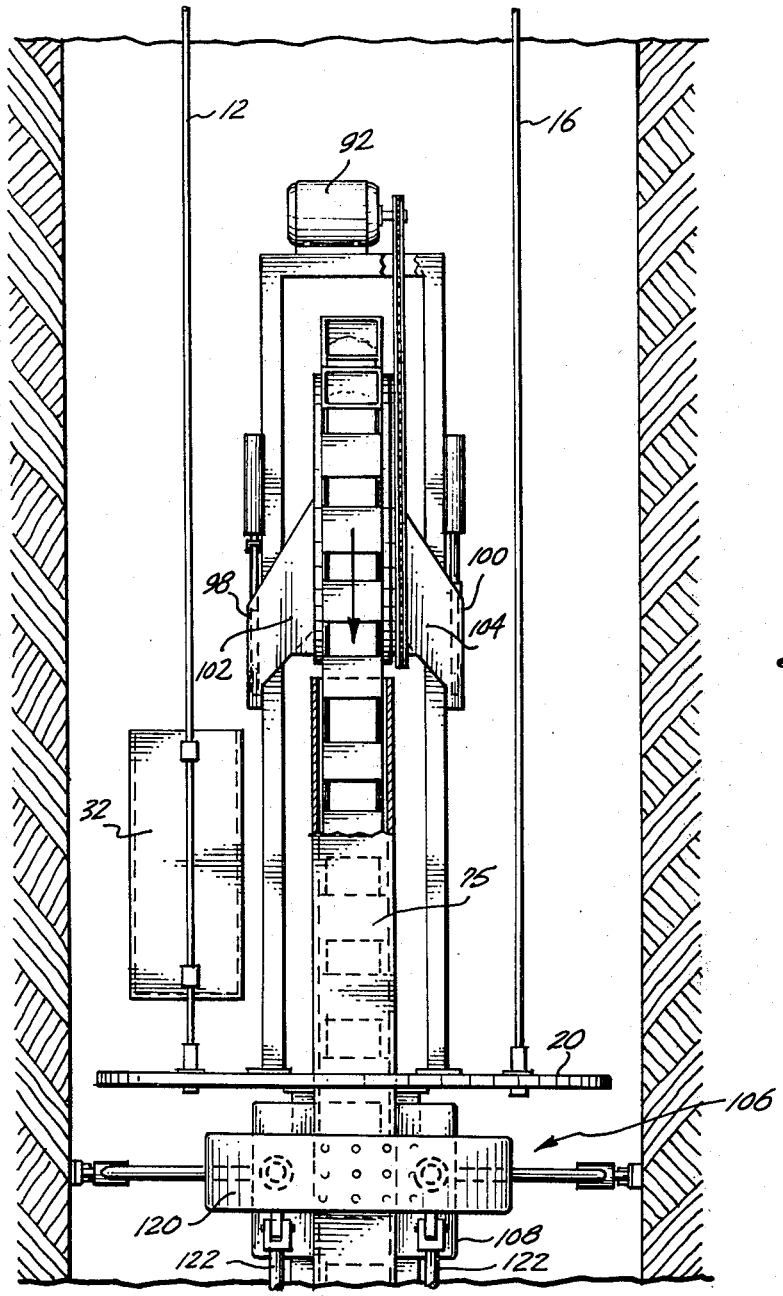
FIG. 4B is a view like FIG. 3B, but looking axially of the cutter wheel.
Figure 5:
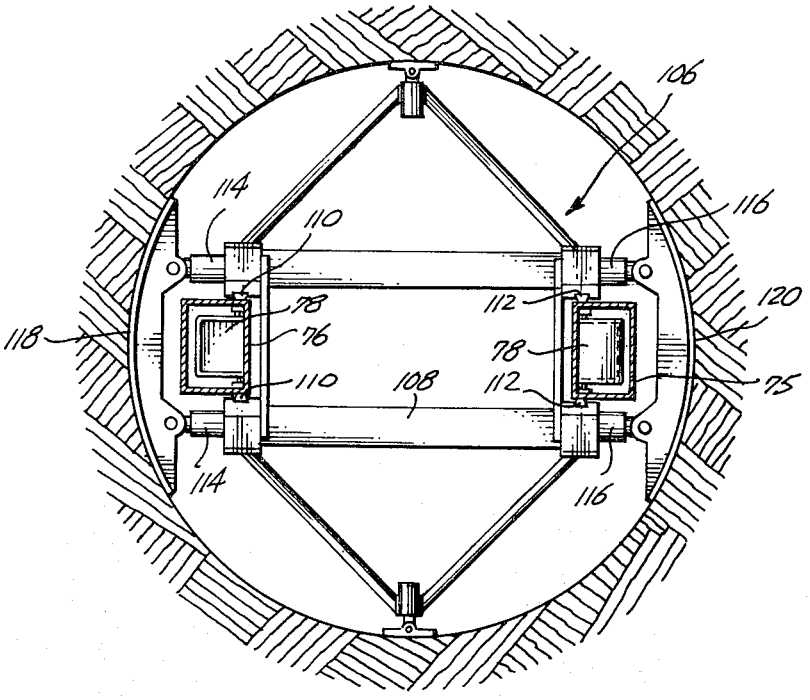
FIG. 5 is a sectional view through the machine above the gripper assembly, taken essentially along line 5—5 of FIG. 3A.
Figure 6:
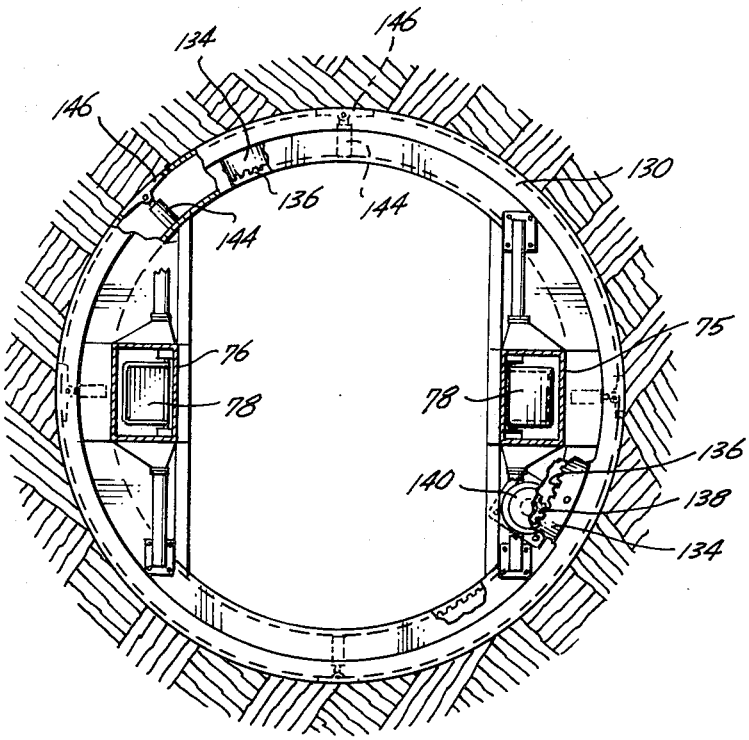
FIG. 6 is a sectional view taken through the machine substantially along line 6—6 of FIG. 3A, with some parts being broken away for clarity of illustration of some other parts.

As shown by FIGS. 3A and 3B, the endless bucket conveyor 78 passes axially through tubular support 58, then upwardly on one side of wheel 60, then across the machine 10, and then downwardly on the opposite side of wheel 60, to again pass through tubular support 58. At the upper end of its run the conveyor 78 is adapted to discharge the cuttings into a hopper 80 and from such hopper 80 the cutters are discharged into a selected one of the lift buckets 34, 32.

The hopper 80 may be in the form of a drum which is secured to, and is a part of, a cross frame 82 which is rigidly interconnected between the upper ends of the frame parts 75, 76. Hopper 80 is mounted on top of cross frame 82 and is rigidly connected thereto by means including support legs 84, 86.

The endless bucket conveyor 78 is guided over the top of the hopper 80. A large diameter sprocket 88 which drivenly engages the conveyor chain is mounted for rotation relative to the hopper 80. A drive chain 90 drivenly interconnects a drive motor 92 with the sprocket 88. Motor 92 is mounted onto a frame member 94 which occupies a fixed position relative to the hopper 80 and the frame parts 58, 74, 76, 82, 84, 88.

The buckets of conveyor 78 dump the cuttings through an opening 96 in the upper portion of hopper 80. Gate controlled outlets 98, 100 are provided on the sides of hopper 80. The outlets 98, 100 open chutes 102, 104 which are arranged to discharge the cuttings into the lift buckets 32, 34, as described above.

A gripper assembly 106 is located above the cutter wheel 60. In principle, gripper assembly 106 and its relationship to the frame parts 75, 76 are like the gripper assembly arrangements found in known tunneling machines of the stepper-advance type, such as the machine shown by U.S. Pat. No. 3,861,746, granted Jan. 21, 1975, to David T. Cass.

Gripper assembly 106 includes a gripper carrier 108 having bearings 110, 112 mounting it for sliding movement relatively along the beam parts 74, 76 of the frame means. Double-acting hydraulic pistons 114, 116 which connect to gripper pads 118, 120, are positioned in line with each other on opposite sides of the carrier 108.

Double-acting hydraulic thrust cylinders 122, 124 are interconnected between outboard portions of carrier 108 and a mounting ring 126 secured to the frame parts 75, 76. In operation, the cylinders 114, 116 are extended for the purpose of urging the gripper pads 118, 120 outwardly into tight gripping contact with the sidewall of the hole. Then, the thrust cylinders 122, 124, which are directed generally axially of the hole, are extended for the purpose of moving the frame means 75, 76, 58, and the cutter wheel 60 carried thereby, vertically downwardly relative to the anchored gripper assembly 106. At the same time, the motor(s) 64 is operated to drive the cutter wheel 60, so that the leading peripheral portion of cutter wheel 60 will cut into the earth and its buckets will pick up the cuttings. It may be said that the cutter wheel 60 makes a peripheral entry into the earth material as the machine is moved downwardly. This is in distinction to the axial entry made by the cutterheads of tunneling machines of the type shown by the aforementioned U.S. Pat. No. 3,861,748.

The machine is advanced downwardly until the portions of tubular support 58 lying on opposite sides of the wheel come close to the bottom of the hole (see FIG. 3A). Then, with gripper assembly 106 still firmly anchored, the thrust cylinders 122, 124 are retracted for the purpose of moving the frame means 75, 76, 58, and the cutter wheel 60 carried thereby, upwardly to withdraw cutter wheel 60 from the cut C1 that is just finished.

A ring-like frame or collar 130 surrounds the machine below the mounting ring 126. The mounting ring 126 and a support means 132 below collar 130, serve as axial restraints for the collar 130. Collar 130 carries a large diameter gear 134 having inwardly directed teeth 136. These teeth 136 mesh with the teeth of a small diameter drive gear 138 which is driven by a drive motor 140 that is mounted on a portion of the frame means. Collar 130 carries a plurality of gripper units 144, each comprising a radially extending double-acting cylinder with a gripper pad at its outer end. When extended cylinders 144 move the gripper pads 146 outwardly and into tight gripping contact with the sidewall of the hole. When retracted they pull the gripper pads 146 inwardly, free of the wall.

Following retraction of the cutter wheel 60 out from a cut (e.g. cut C1), in the manner described above, the cylinders 144 are extended for the purpose of making the gripper pads 146 grip the sidewall of the hole, to in that manner firmly anchor the collar 130 in position relative to the sidewall of the hole. Then, the gripper assembly cylinders 114, 116 are retracted and the motor 140 is used for rotating the machine parts 75, 76, 58, 60 about the axis of the hole. Rotation continues until the cutter wheel 60 is properly positioned to make a second cut C2 (FIG. 8) which extends diagonally across the first cut C1. Then, gripper cylinders 114, 116 are again extended, for the purpose of again tightly gripping the side walls of the hole and anchoring the gripper assembly in place. Also, the collar cylinders 144 are retracted to free collar 130 from the side wall of the hole.

Then, cutter wheel 60 is again rotated and the thrust cylinders 122, 124, are again extended, for the purpose of making a second cut C2. The above described procedure is repeated as many times as necessary in order for the cutter wheel 60 to cut a hole of the desired cross-sectional shape. The machine of the first embodiment is designed to be rotated about the axis of the hole three times to form three cuts C1, C2, C3 (FIG. 8) for each setting of the gripper assembly 106. The peripheral cutting portion of the cutter wheel 60 is adapted to form a spherical segment cut face. The three cuts C1, C2, C3 together form a generally spherical curvature hole face and a circular hole cross-section.

At the end of the third cut C3 the gripper cylinders 114, 116 are retracted for the purpose of detaching the gripper pads 118, 120 from the side wall of the hole, thereby freeing the gripper assembly 106 for travel relatively along the beam portions 75, 78 of the frame. Then, the thrust cylinders 122, 124 are retracted while the gripper cylinders 114, 116 are still retracted. This results in a lowering of the gripper assembly 106 into a new position. Then, the gripper cylinders 114, 116 are again retracted, for the purpose of again anchoring the gripper assembly in place. Then, another increment of the hole (i.e., another three cuts C1, C2, C3) is bored by repeating the above described process.

A feature of the first embodiment is that rotation of the frame means, including the platform 20, makes it necessary to either rotate the surface equipment about the hole, or to tolerate a twisting of the guide cables 12, 14, 16, 18. Also, the entire machine must be moved vertically between cuts. The embodiment of FIGS. 9 – 12, which will now be described, is divided into an upper portion 148 and a lower portion 150. The guide cables 12′, 14′, 16′, 18′, are connected to the upper portion 148 and the main gripper assembly is a part of the gripper portion 148. The lower portion 150 is adapted to be rotated relative to the upper portion 148, for the purpose of rotating the cutter wheel to make the plural cuts. Vertical movement between the cuts is limited to the lower portion 150 only.

Referring now to FIGS. 9– 12, the cables 12′, 14′, 16′, 18′ are connected to a platform 152. As in the earlier embodiment, cables 12', 14' serve as guide lines for a first lift bucket 32'. Cables 16', 18' serve as guide lines for a second bucket (not shown). Platform 152 may be provided with alignment jacks 153.

At the lower end of the machine a cutter wheel 60' is mounted for rotation about a hollow tubular support portion of a frame means which is comparable to the frame means of the first embodiment. As before, cutters carried by the cutter wheel 60' cut the material as the leading peripheral portion of the cutter wheel 60' is moved into the earth material. Buckets on the cutter wheel 60' pick up the cuttings and deliver them inside the tubular support. Inside such support they are picked up by endless type conveyor which carries them upwardly to a discharge station. In this embodiment the tubular support for the cutter wheel 60', the two hollow side beams 154, 156 which are connected to the ends of the tubular support and extend upwardly therefrom the parallelism with each other, and a cross frame 158 which bridges across the upper ends of frame parts 154, 156, together form an elongated closed loop type structure which is comparable in appearance to a chain link.

In the embodiment of FIGS. 9 – 12 the endless conveyor 78' extends over a pair of spaced apart sprockets 160, 162 at the upper end of its run. One of the sprockets 162 is driven by a motor 164 which is mounted on the frame means of the lower part 150. The cuttings are dumped from the buckets into a hopper 166 having a cylindrical lower end portion which is concentric with the center line of the machine and the hole bored thereby. This cylindrical tube 168 makes a telescopic and rotatable engagement with a second tube 170 which is connected to a hollow frame portion 172 of the upper part 148. The portion of this frame means 172 below the platform 152 is comparable in appearance to a link of chain with one end removed. The general plane of upper frame means 172 crosses the general plane of the lower frame means.

The gripper assembly 106' is essentially like gripper assembly 106, so it will not be redescribed other than to say it includes gripper pads 118', 120' disposed on opposite sides of the machine. Gripper assembly 106' depends from and is connected to the upper frame means 172.

A second endless conveyor 174 (e.g. also of the endless bucket type) is guided through the generally U-shaped frame means 172 and above platform 152 it extends over a drum-like hopper 80'. The construction and arrangement of hopper 80', the manner in which the conveyor 174 is guided over it and is driven, and the manner that cuttings are removed from hopper 80' into the lift buckets 32', 34', are the same as has already been described above in connection with the first embodiment.

In this embodiment a single centrally located thrust ram 176 is provided for advancing and retracting the cutter wheel 60', and for advancing the gripper assembly 106'. The lower frame means may include a hollow beam 178 in which thrust cylinder 176 is housed. Beam 178 is not circular so that a rotational drive of it will transmit a rotative torque to the lower housing 178. The thrust cylinder 176 is a double-acting hydraulic cylinder. It is pivotally connected at its upper end 182 to a portion of the upper frame means and is connected at its lower end 184 to a portion of the lower frame means.

In operation, the gripper pad cylinders of the gripper assembly 106' are extended outwardly to engage the side wall of the hole for the purpose of anchoring the upper portion 148 in place within the hole. Extension of the thrust cylinder 178 then causes a downwardly movement of the lower frame means and the cutter wheel carried thereby relative to the anchored upper frame means.

The lower portion 150 of the machine may be provided with steering pads 186, 188, 190, 192 in the vicinity of the cutter wheel 60'.

At the conclusion of a cut (e.g. a cut C1 like in FIG. 8) the cutter wheel 60' is rotated about the axis of the hole and relative to the anchored gripper assembly 106'. In this embodiment beam 178 extends through guide bearings 186 which are carried by a rotatable ring 188 having gear teeth 190 on its outer periphery. Guide bearings 186 mount beam 178 for relative sliding movement relative to ring 188. These gear teeth engage with a worm gear 192 or the like which is carried by the upper frame means and is rotatable by drive motor 194. Rotation of gear 192 causes rotation of ring 188 which in turn rotates tube 178 and the remaining components of the lower portion 150 of the machine, including the cutter wheel 60'. Beam 178 functions as the so-called "beam" portion of the cutter wheel support along which the gripper assembly 106' is mounted for relative sliding movement, so that a stepper type of advance can be achieved.

Obviously, the type of connection which exists between the upper and lower parts 148, 150 of the machine will not allow an unlimited amount of rotation of the lower part 150 relative to the anchored upper part 148. However, sufficient rotation is allowed before any interference between the two frame means would occur to prevent the cutter wheel 60' to form the necessary cut pattern of the type illustrated by FIG. 8.

As previously mentioned, the embodiment of FIGS. 9 – 12 represents one way of constructing the machine so that the upper portion of the machine does not have to be rotated or moved up and down when it becomes necessary to rotate the cutter wheel 60' for the purpose of making the plurality of cuts which are necessary to excavate each vertical increment of the hole.

Figure 9:
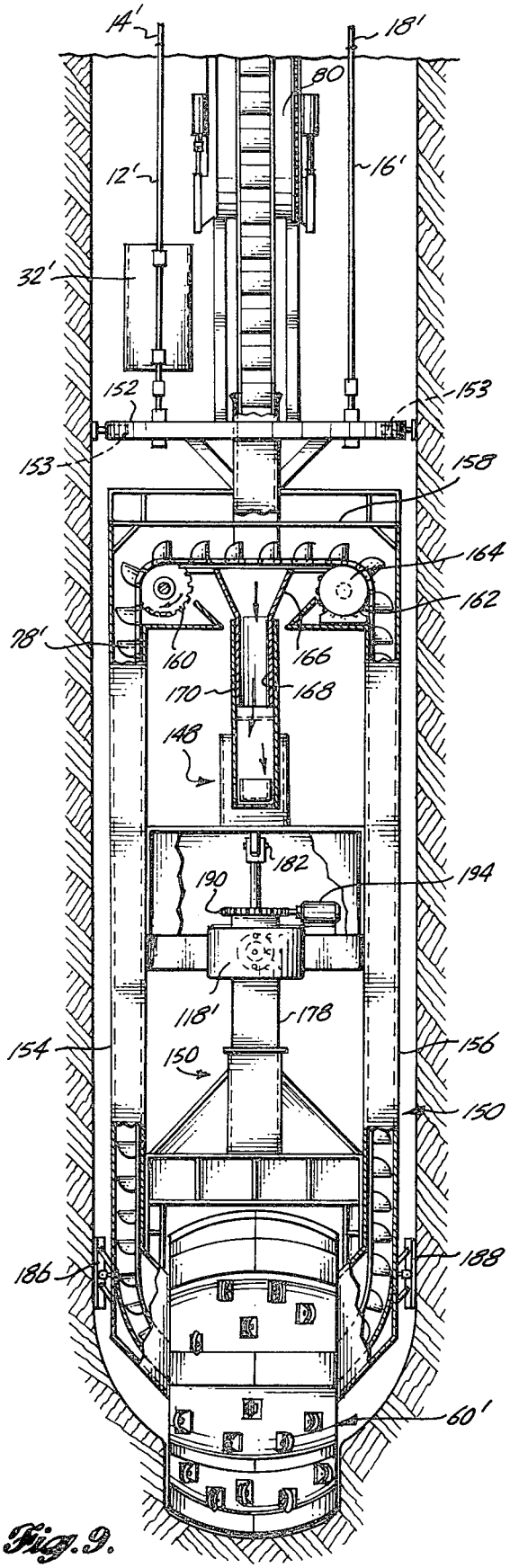
FIG. 9 is a view like FIGS. 3A and 3B combined, but of a second embodiment of the invention and on a reduced scale.
Figure 10:
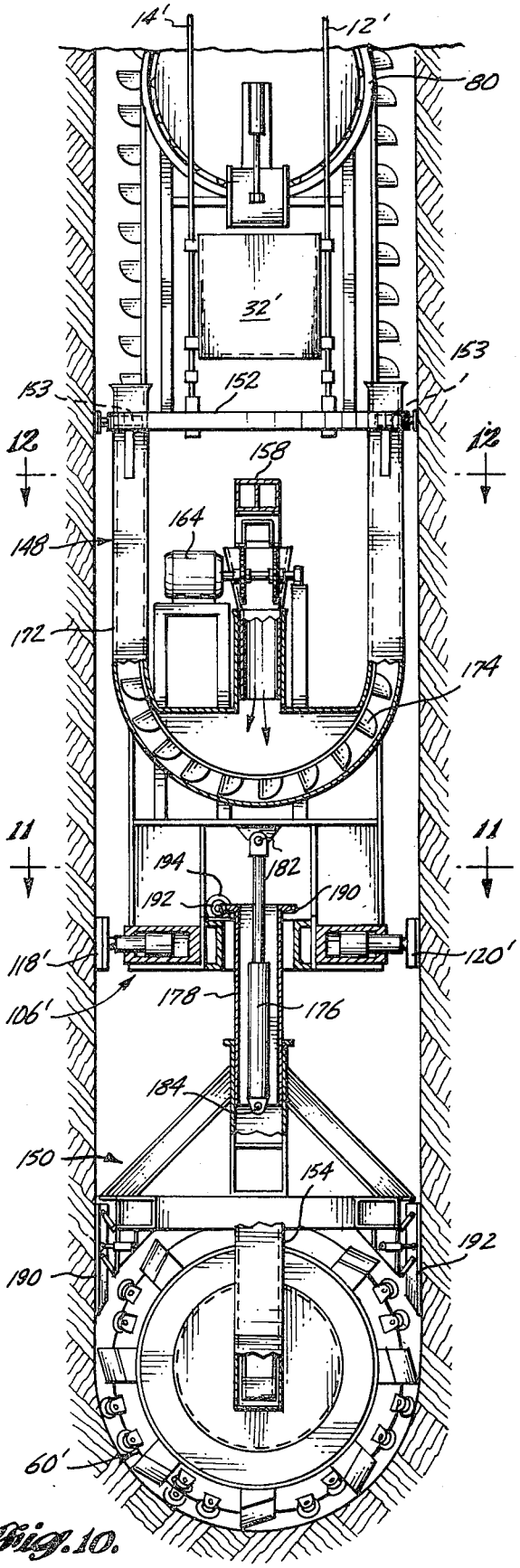
FIG. 10 is a view like FIGS. 4A and 4B combined, but of a second embodiment and on a reduced scale.
Figure 11:
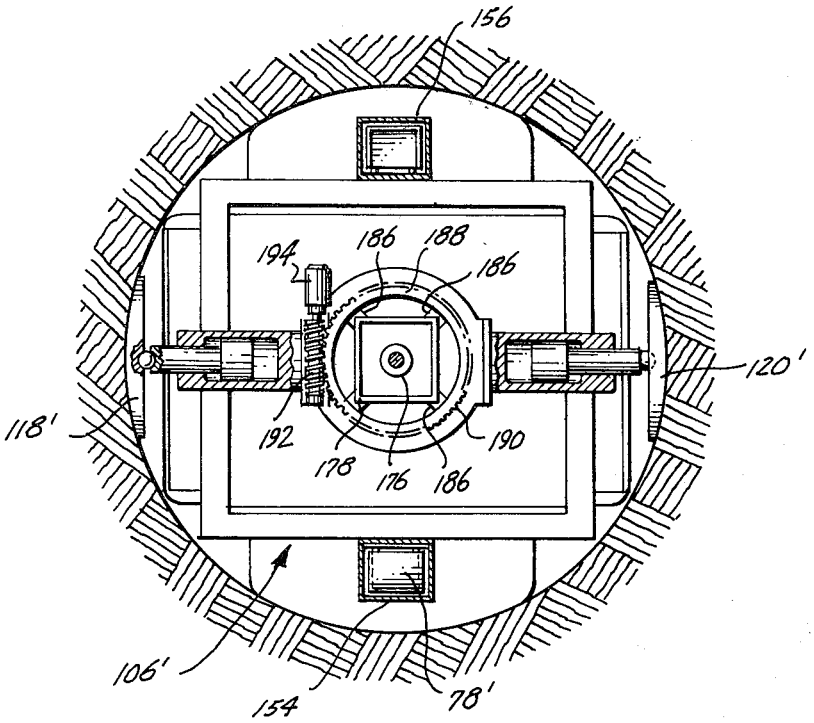
FIG. 11 is a cross-sectional view taken substantially along line 11—11 of FIG. 9.
Figure 12:
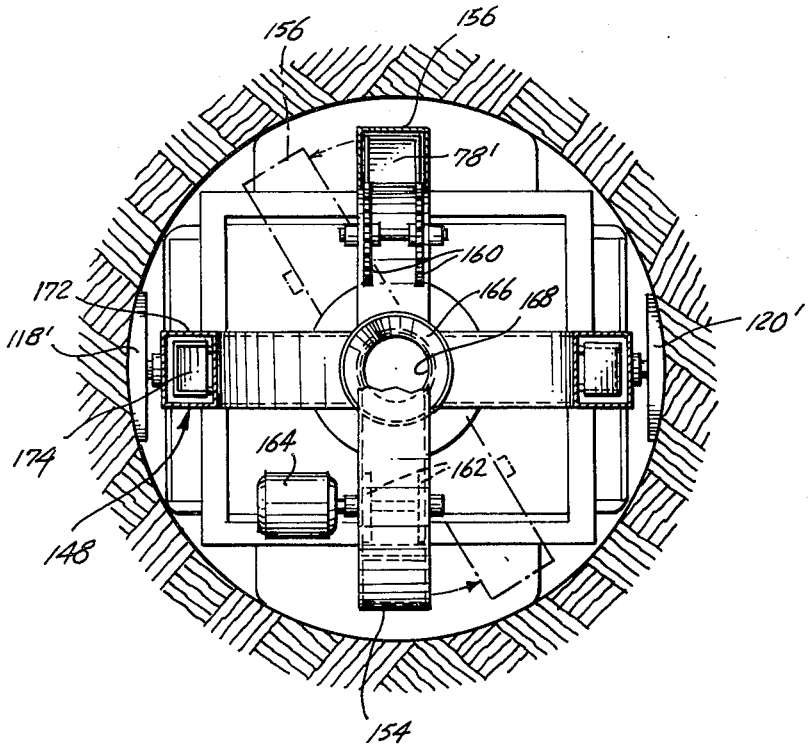
FIG. 12 is a cross-sectional view taken through the second embodiment, substantially along line 13—13 of FIG. 10, and including a broken line position of the conveyor support housing following rotation of the lower part of the machine.

As should be evident from FIGS. 9 and 10, the cuttings which are deposited by the lower conveyor 78' through hopper 168 are deposited into the lower portion of upper frame means 172. The cuttings are picked up therein by the buckets of the upper conveyor and are carried upwardly thereby to the hopper 80'. They are deposited into the hopper 80', and in a controlled fashion are selectively released from one or the other of the outlets into the lift buckets 32', 34'.

The vertical hole boring machines of this invention may be equipped with shields for supporting the ground as boring progresses. The shield may be a tubular member mounted to travel with the frame means for the cutterhead or with the gripper assembly or, a telescopic shield might be used, with one portion traveling with the cutterhead support means and the other with the gripper assembly. The boring operation may include the steps of constructing some sort of temporary and/or permanent wall support or lining behind the machine as boring progresses.

FIGS. 13 – 16 illustrate a third embodiment of the invention. It comprises a telescopic shield composed of a lower section 202 and an upper section 204. A gripper assembly 206, shown in the form of a hollow ring being equipped with a plurality of radially extending gripper cylinders 208 having sidewall engaging pads 210, is carried by the upper shield section 204. A plurality of axially extending thrust rams 212 are interconnected between ring beam 206, and hence upper shield section 204, and mounting brackets 214 which are a part of the lower shield section 202.

A main machine deck 216 is mounted for rotation within the lower shield section 202. Rotation is about a center line C/L which coincides with the vertical center of the hole. Support beams 218, 220 extend below main machine deck 216 and terminate in a slide member 222.

As in the earlier embodiments, the machine includes a cutter wheel 60″ which includes frame means mounting it for rotation about a horizontal axis, i.e., an axis extending transversely to the longitudinal axis of the machine. The frame means includes a tubular support member at its lower end and side beams which carry an endless bucket conveyor and which extend upwardly from the cutter wheel 60″ on opposite sides thereof in similar fashion to the tines of a bicycle wheel support fork. The bucket conveyor passes up one support beam 230, extends over a guide means at the upper end of the frame means, and then passes downwardly along the other frame member 230 and returns to the tubular cross support for the cutter wheel 60″. At the upper end of its run the conveyor dumps the cuttings which is picked up within the tubular support. The receiving receptecle for such cuttings and the manner in which the cuttings are removed from within the machine will be described below.

A cross beam 234 extends between the two side beams 230, 232 and it mounted by legs 235 to the main deck 216. Beam 234 includes slideways at its two ends which engage the two sidebeams 230, 232. A main thrust cylinder 236 is connected at its lower end, at point 238, to the frame means which immediately supports the cutter wheel 60″. At its upper end the thrust cylinder is connected to the cross beam 234. Since beam 234 is connected to the main machine deck, it can be said that the upper end of the main thrust cylinder 236 is connected to the main machine deck 216.

Extension of main thrust cylinder 236, which is a double-acting hydraulic cylinder, causes a downward movement of the cutter wheel support means and hence the cutter wheel 60″ carried thereby, relative to the main machine deck. Retraction of thrust cylinder 238 raises the cutterhead support means, drawing the cutter wheel 60″ towards the main machine deck 216.

A lower portion of the cutterhead support means includes a longitudinal guideway 240 which receives the guide member 222. The connection between guide member 222 and guideway 240 braces the cutterhead support means from the main machine deck, but allows the above described relative movement axially of the machine.

Main machine deck may be equipped with a large diameter ring gear 242 which engages a small diameter drive gear 244 driven by a motor 246.

Let it be assumed that the cylinders 212 are retracted, the gripper cylinders 208 of gripper assembly 206 are extended, for the purpose of firmly anchoring the upper portion 204 of the shield in the hole, main thrust cylinder 236 is retracted, and the machine is ready to start cutting a hole.

In operation, the drive motor for the cutter wheel 60″ is turned on and the main thrust cylinder 236 is extended, for the purpose of causing a peripheral entry of the cutter wheel 60″ into the earth. The cutter wheel 60″ is advanced downwardly until a first cut of the type described above in connection with the earlier embodiments is completed. However, in this third embodiment, it will be noted that the diameter of the cutter wheel 60″ is by way of example, one-half the diameter of the hole to be formed, whereas in the earlier embodiments the two diameters are equal.

Following formation of the first cut, the main thrust ram 236 is retracted for the purpose of raising the cutter wheel 60″ out from the cut. Then, motor 246 is turned on for the purpose of rotating the main machine deck around the center C/L to place the cutter wheel into a new position which is angularly adjacent to the first position. The selected width of the cutter wheel 60″ determines the number of cuts which must be made in order to complete an axial segment of the hole. By way of typical and therefore non-limitive example, the illustrated embodiment has a cutter wheel width which results in 30° movements of the cutter wheel 60″, i.e., 12 cuts per position of the gripper assembly 206.

The thrust cylinders 212 are provided so that for each cut they can be extended a small amount in addition to the extension of the main thrust ram 236. In this manner, the cutter wheel can be operated to follow a generally downwardly winding helical path. For each position of the gripper assembly 206, the increments of extension of the thrust cylinders 212 would be equal to the number of cuts necessary to complete the round (e.g. twelve in the illustrated embodiment).

Following the last cut, or at some predetermined interval, the thrust cylinders 212, 236 are retracted for the purpose of lowering the gripper assembly 206 into a new position.

The lower shield section 206 may be provided with radially adjustable skirt segments 248, for stabilizing the machine and providing some ground support. A support beam 250 may depend downwardly from the main machine deck at a location radially inwardly of each segment 246, to serve as a support for parallel linkages 252, 254 and a control cylinder 256.

Figure 13:
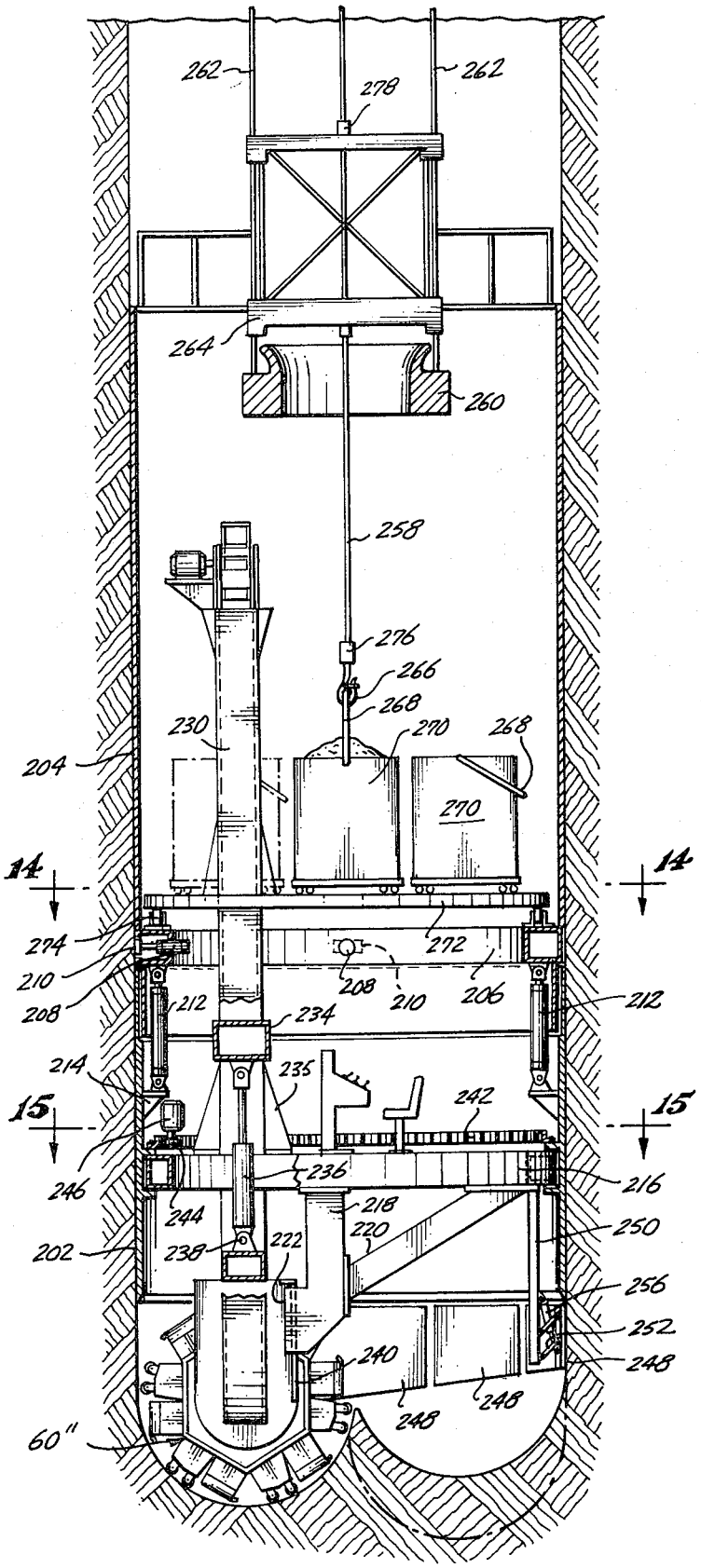
FIG. 13 is a vertical sectional view, with some parts in elevation, of a third embodiment of the invention.
Figure 14:
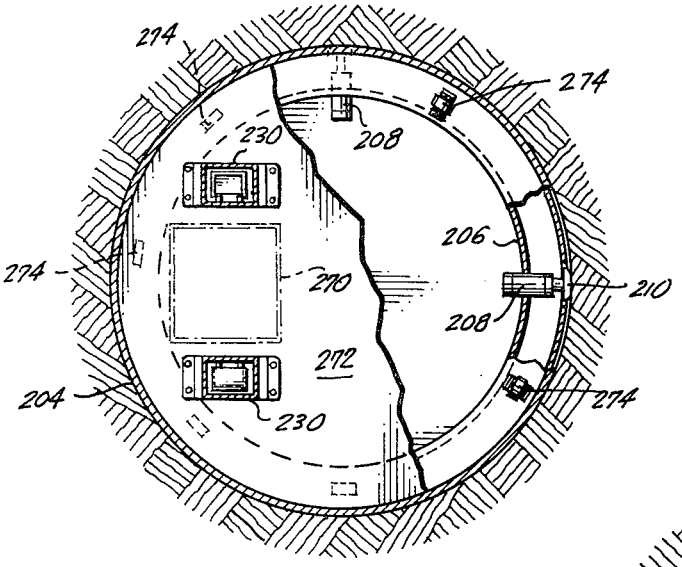
FIG. 14 is a sectional view taken through the machine of FIG. 13, immediately above a gripper assembly, substantially along line 14—14 of FIG. 13.
Figure 15:
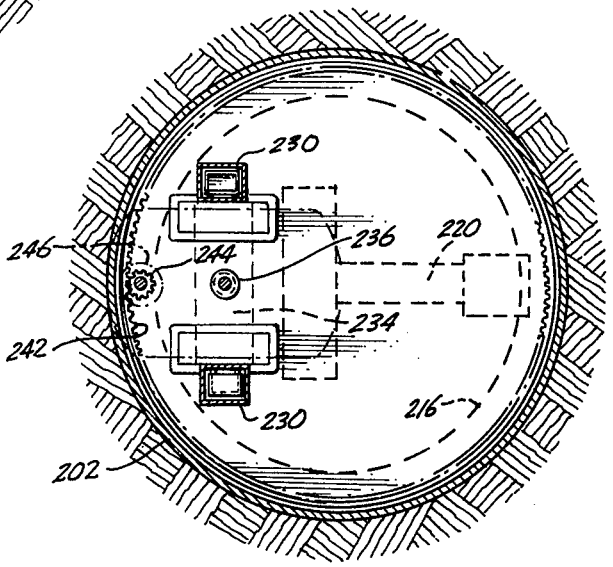
FIG. 15 is a cross-sectional view taken through the machine of FIG. 13, a short distance above a rotatable main deck, substantially along line 15—15 of FIG. 13.
Figure 16:
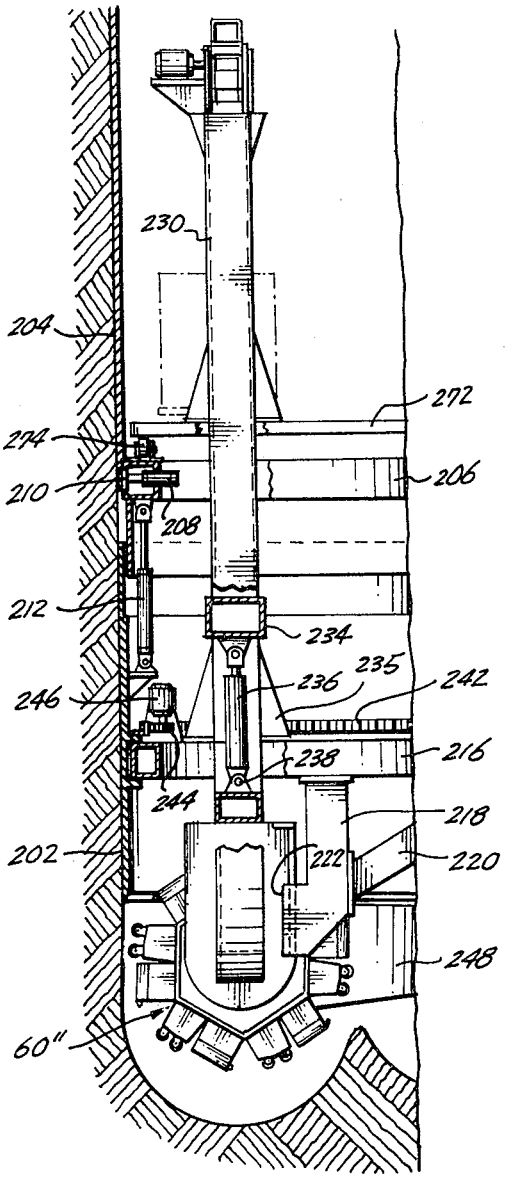
FIG. 16 is an enlarged scale fragmentary view of a portion of the third embodiment, showing the main thrust ram.

In this embodiment the cuttings may be removed from the vicinity of the machine by means of a bucket system which includes a centrally disposed hoist line 258. In a manner which is believed to be conventional per se, a plural line guide system is provided around hoist line 258. The lower ends of the guide lines are connected to a large counterweight 260. A cage like structure is mounted for movement up and down the guide lines. The hoist rope 258 extends downwardly through the upper end of the cage to a releasable type of fastener 266. In FIG. 13 this fastener 266 is shown in the form of a hook connected to a bail 268 on a lift bucket 270.

Deck 272 is supported for rotation by bearings 274 located between it and the beam 206. The cutterhead support frame means 230 is connected to deck 272, so when main machine deck 216 is rotated, and such frame means 230 is orbited, the deck 272 also rotates. As shown, the deck 272 has sufficient space to hold two buckets. FIG. 13 shows a full bucket about to be raised, a second empty bucket, and a broken line showing of the cuttings receiving position of each bucket.

The buckets 270 are set down onto wheeled dollies so that they can be easily moved around on the deck 272. When it is desired to raise a full bucket, such bucket is wheeled into a position below hoist line 258. The hook 266 is secured to its bail 268. Then, the hoist line 258 is raised. When the upper portion 276 of hook 266 reaches the top of cage 264, it encounters a guide 278 through which the hoist line 258 passes. Then, any additional upward movement of the hoist line 258 will cause an upward movement of the cage 264 with the bucket 270.

As will be readily appreciated, when an empty bucket is lowered the cage 264 will travel with it until the cage 264 becomes bottomed on the weight 260. Then, the bucket 270 will move downwardly by itself out from within the confines of cage 264, to the work deck 272.

As illustrated in FIG. 13, an operator's control station may be provided on the main machine deck in the room-like space which exists.

An advantage of the embodiment shown by FIGS. 13 – 16 is that it is a simpler structure than the first two embodiments and can be manufactured at a much lower cost. Hence, it is feasible for use in boring relatively short vertical holes. Another advantage of this construction is that the offset arrangement of the cutter wheel 60'' provides a substantial amount of space at the lower end of the machine in which grouting or other functions can be carried out.

It is to be understood that the illustrated embodiments are provided only as examples of the invention. Other embodiments may be made but it would be impractical to illustrate them all in this document. Consistent with the laws of patent interpretation, the protection of this patent is not to be limited by the illustrated embodiments, but only by interpretations of the following claims which have been intentionally written to describe certain basic features of the invention which appear in the illustrated embodiments but which may appear in additional embodiments as well.

What is claimed is:

1. An earth boring machine for boring a transversely large hole, comprising:

a cutter wheel including a peripheral cutter portion;

means mounting said cutter wheel for rotation about an axis transverse to the hole;

motor means for driving said cutter wheel about said axis;

advance-retract means for advancing said cutter wheel into the earth material being cut while said cutter wheel is being rotated, and for retracting said cutter wheel out from its cut;

means for maintaining said cutter wheel and its mounting means in a fixed angular position relative to the axis of the hole while said cutter wheel is being rotated and advanced into the earth material, so that said cut is in the shape of the leading portion of the cutter wheel; and means for angularly shifting said cutter wheel and its mounting means in position about the axis of the hole following retraction of the cutter wheel from a cut, to establish a new cut path which is at an angle to the first cut path.

2. An earth boring machine according to claim 1, for boring a large diameter circular hole wherein the wheel diameter substantially equals the hole diameter.

3. An earth boring machine according to claim 1, for boring a large diameter circular hole, wherein said wheel is smaller in diameter than the hole.

4. An earth boring machine for boring a transversely large hole, comprising:

a cutter wheel including a peripheral cutter portion;

means mounting said cutter wheel for rotation about an axis transverse to the hole;

motor means for driving said cutter wheel about said axis;

advance-retract means for advancing said cutter wheel into the earth material being cut while said cutter wheel is being rotated, and for retracting said cutter wheel out from its cut;

means for angularly shifting said cutter wheel and its mounting means in position about the axis of the hole following retraction of the cutter wheel from a cut, to establish a new cut path which is at an angle to the first cut path;

frame means including a support for the cutter wheel and a beam portion extending longitudinally of the hole from said support; and wherein said advance-retract means comprises a gripper assembly spaced from said cutter wheel and guided on said beam portion, for relative movement therealong longitudinally of the hole, said gripper means including gripper shoes which are extendible laterally outwardly from the machine to engage and fractionally grip the side wall of the hole, and are retractable laterally inwardly towards the machine, to be free of gripping contact with such side wall, and extendible-retractable leg means extending generally longitudinally of the hole, said leg means being interconnected between said gripper means and said frame means relatively adjacent said cutter wheel.

5. An earth boring machine for boring a transversely large hole, comprising:

a cutter wheel including a peripheral cutter portion;

means mounting said cutter wheel for rotation about an axis transverse to the hole;

motor means for driving said cutter wheel about said axis;

advance-retract means for advancing said cutter wheel into the earth material being cut while said cutter wheel is being rotated, and for retracting said cutter wheel out from its cut;

means for angularly shifting said cutter wheel and its mounting means in position about the axis of the hole following retraction of the cutter wheel from a cut, to establish a new cut path which is at an angle to the first cut path;

frame means including a support for the cutter wheel and a beam portion extending longitudinally of the tunnel from said support; and wherein the means for angularly shifting said cutter wheel and its mounting in position about the axis of the hole when it is retracted from a cut comprises a collar which extends about said frame means, means on said frame means for restraining the collar against longitudinal movement relative to the frame means, but permitting it to rotate relatively about said frame means, gripper means on said collar operable to grip a side wall portion of the hole, for the purpose of restraining such collar against rotation relative to the side wall of the hole, and means for rotating said frame means and the cutter wheel carried thereby relative to the collar.

6. An earth boring machine for boring a transversely large hole, comprising:

a cutter wheel including a peripheral cutter portion;

means mounting said cutter hweel for rotation about an axis transverse to the hole;

motor means for driving said cutter wheel about said axis;

advance-retract means for advancing said cutter wheel into the earth material being cut while said cutter wheel is being rotated, and for retracting said cutter wheel out from its cut;

means for angularly shifting said cutter wheel and its mounting means in position about the axis of the hole following retraction of the cutter wheel from a cut, to establish a new cut path which is at an angle to the first cut path;

reaction means in said hole anchorable against rotation;

frame means including a support for said cutter wheel about which such wheel is mounted for rotation and beam means extending from said support at last to said reaction assembly; and wherein said means for angularly shifting said cutter wheel and its mounting in position about the axis of the hole comprises drive means carried by said reaction assembly and said frame means, for rotating said frame means and the cutter wheel carried thereby in position within the hole relative to said reaction means.

7. An earth boring machine for boring a transversely large hole, comprising:

a cutter wheel including a peripheral cutter portion, said wheel being smaller in diameter than the hole;

means mounting said cutter wheel for rotation about an axis transverse to the hole;

motor means for driving said cutter wheel about said axis;

advance-retract means for advancing said cutter wheel into the earth material being cut while said cutter wheel is being rotated, and for retracting said cutter wheel out from its cut;

means for angularly shifting said cutter wheel and its mounting means in position about the axis of the hole following retraction of the cutter wheel from a cut, to establish a new cut path which is at an angle to the first cut path; and auxiliary advance means for progressively advancing the cutter wheel an additional amount for each successive cut in a succession of cuts, so that the cutter wheel cuts follow a helical path.

8. An earth boring machine according to claim 7, wherein said advance-retract means comprises double-acting thrust cylinder means extending longitudinally of the hole between a cutterhead support and a forward frame part, and wherein said auxiliary advance means comprises additional double-acting thrust ram means extending longitudinally of the hole between a gripper assembly and said forward frame part.

9. A method of boring a transversely large hole, comprising:

power rotating a cutter wheel having a peripheral cutter portion about an axis transverse to the hole;

maintaining said rotating cutter wheel in angular position relative to the axis of the hole while advancing a leading peripheral portion of said rotating cutter wheel into the earth material to form a first cut;

retracting said cutter wheel out from said first cut; and angularly shifting said cutter wheel in position about the axis of the hole following its retraction from the first cut, to establish a new cut path which is at an angle to the first cut path.

10. An earth boring method according to claim 9, for boring a large diameter circular hole, by utilizing a cutter wheel having a diameter that is substantially equal to the diameter of said hole, and its axis of rotation intersects the longitudinal axis of the hole, and wherein said cutter wheel is angularly shifted in position by rotating it about the longitudinal axis of the hole.

11. A method or boring a transversely large hole, comprising:

utilizing a cutter wheel having a peripheral cutter portion a diameter that is smaller than the diameter of the hole and which rotates about an axis which is both perpendicular to and radially offset from the longitudinal axis of the hole;

power rotating said cutter wheel about an axis transverse to the hole;

advancing a leading peripheral portion of said rotating cutter wheel into the earth material to form a first cut;

retracting said cutter wheel out from said first cut; and angularly shifting said cutter wheel in position about the axis of the hole following its retraction from the first cut, to establish a new cut path which is at an angle to the first cut path.

12. An earth boring method according to claim 11, further comprising advancing said cutter wheel forwardly an additional amount for each cut, so that said cuts will follow a helical path.

13. An earth boring machine for boring a transversely large hole vertically downwardly, comprising:

frame means including a horizontal tubular support near the lower end of the machine;

a cutter wheel at the lower end of the machine mounted for rotation about said horizontal tubular support;

cutter means on the periphery of said cutter wheel;

motor means for rotating said cutter wheel about said horizontal tubular support;

means for advancing said machine vertically downwardly to plunge a leading peripheral portion of said cutter wheel into the earth material being cut while said cutter wheel is being rotated;

means for directing cuttings through said cutter wheel and into said horizontal tubular support; and conveyor means mounted for picking up said cuttings, inside said horizontal tubular support and carrying them to a discharge station.

14. An earth boring machine according to claim 13, wherein the conveyor means is endless and is mounted to pass axially through said horizontal tubular support, to pick up said cuttings, then upwardly on said one side of the wheel to said discharge station, and then downwardly on the opposite side of the wheel, to again pass through said horizontal tubular support.

15. An earth boring machine according to claim 13, wherein said horizontal tubular support includes a side opening therein, and the means for directing cuttings through said cutter wheel and into said horizontal tubular support comprises said side opening, and bucket means carried by the cutter wheel, adapted to scoop up cuttings and then, upon rotation of the bucket means to a relatively upper position, to discharge such cuttings through said side opening and into the interior of the horizontal tubular support.

16. An earth boring machine according to claim 13, comprising a large diameter gear on said cutter wheel which surrounds said horizontal tubular support, and motor means carried by said frame means, including drive means connected to said gear.

17. An earth boring machine according to claim 13, wherein the cutter means on the periphery of said cutter wheel comprises a plurality of roller type cutter elements mounted to both rotate and penetrate into the earth material while the cutter wheel is rotating and the machine is being advanced vertically downwardly into the earth material being cut.

18. An earth boring machine according to claim 13, for boring a large diameter circular hole, further including means for retracting said cutter wheel from the cut formed by the leading peripheral portion thereof, and means for angularly shifting said cutter wheel in position about the axis of the hole for establishing a new cut path at an angle to said cut.

* * * * *